United States Patent [19]

Gibbs

[11] 4,257,659

[45] Mar. 24, 1981

[54] ELECTRICAL CONNECTOR WITH SAFETY COVER MEANS

[75] Inventor: Ronald D. Gibbs, Naperville, Ill.

[73] Assignee: Belden Corporation, Geneva, Ill.

[21] Appl. No.: 80,109

[22] Filed: Sep. 28, 1979

[51] Int. Cl.[3] ..... H01R 13/44

[52] U.S. Cl. ..... 339/36; 339/40

[58] Field of Search ..... 339/36–41; 174/67

[56] References Cited

U.S. PATENT DOCUMENTS

| | | | |
|---|---|---|---|
| 2,552,061 | 5/1951 | Popp | 339/36 |
| 3,760,130 | 9/1973 | Ross et al. | 339/37 |
| 3,810,070 | 5/1974 | Ludwig | 339/36 |
| 4,094,569 | 6/1978 | Dietz | 339/40 |

*Primary Examiner*—Neil Abrams

*Attorney, Agent, or Firm*—Fitch, Even, Tabin, Flannery & Welsh

[57] ABSTRACT

An electrical connector of the extension type having multiple plug-in receptacles opening onto opposed surfaces of a connector body, a pair of cover plates being mounted on the connector body for selective movement to expose one, two or three of the receptacles for insertion of electrical plugs or to simultaneously shield all of the receptacles. The cover plates may also be employed to insure proper polarization when a polarized plug is used with the connector.

6 Claims, 7 Drawing Figures

ELECTRICAL CONNECTOR WITH SAFETY COVER MEANS

The present invention relates to electrical connectors of the extension or cube type having multiple receptacles opening into opposite surfaces of the connector body, and more particularly to such a connector having safety cover means in the form of a pair of covers mounted on the connector body for movement to selectively expose the receptacles to receive electrical plugs therein or to shield the receptacles to prevent insertion of plugs.

Electrical connectors of the type contemplated by the present invention are commonly employed to provide multiple plug-in receptacles for receiving one or more electrical plugs. The present invention particularly contemplates a connector of the extension or cube type arranged at the end of an electrical cord for receiving one or more electrical plugs. In such a connector, a portion of the multiple receptacles commonly open onto one surface of the connector while one or more additional receptacles open upon another surface of the connector body.

In such electrical connectors, it is desirable to be able to selectively expose or shield various combinations of the receptacles. For example, when none of the receptacles is in use, shielding is preferably provided for all of the receptacles in order to prevent foreign objects or the like from being inserted into the contact sockets of the receptacles. This is particularly desirable from a safety standpoint in respect to small children. In addition, it is also desirable to be able to selectively expose any number of receptacles depending upon the number to be used at any given time. At the same time, it is of course desirable to continue shielding the remaining unused receptacles. For example, if the connector forms three such receptacles, it may be desirable to simultaneously sheild all of the receptacles or to selectively expose one, two or three of the receptacles for receiving electrical plugs while shielding any remaining unused receptacles.

Many different cover plates have been provided in the prior art for this purpose. For example, separate cover plates have been provided for separate receptacles in order to selectively shield or expose their contact sockets. In some of these designs, the cover plate is rotated in order to permit alignment of the prongs on the plug with the contact sockets. Most if not all of these cover plates have been found to satisfactorily permit the individual receptacles to be either shielded or exposed depending upon whether or not each receptacle is in use. However, the prior art receptacles have been found to be relatively complex in that they include a number of moving parts with spring mechanisms and the like being provided for positioning the covers.

At the same time, the receptacles in such connectors may be of a polarized design requiring proper alignment of the electrical plug in the receptacle in order to assure proper operation of the connector and plug. Provisions for such a polarized arrangement of the electrical plug has not been provided in connector and cover plate combinations of the prior art as discussed above.

Accordingly, there has been found to remain a need for an improved cover plate for such an electrical connector which is of particularly simple construction with a minimum number of parts in order to assure proper operation over extended periods of time and also to provide an improved cover plate adapted for cooperation with connectors of the type having polarized receptacles.

SUMMARY OF THE INVENTION

It is therefore an object of the present invention to provide an improved electrical connector of the extension or cube type having multiple plug-in receptacles with slidable cover plates adapted to selectively shield all of the receptacles or to expose any desired number of the receptacles while shielding the remaining receptacles.

Preferably, this is accomplished in connection with a cube or extension type connector having two receptacles opening onto one surface of the connector body with a third receptacle opening onto an opposite surface of the connector body, a first cover plate being slidably secured to the connector body for simultaneously exposing or shielding the two receptacles opening thereupon, a second cover plate being slidably secured to the connector body for selectively exposing or shielding the receptacle upon the opposite surface thereof.

It is another object of the invention to provide an improved electrical connector of the extension type having multiple receptacles opening upon different surfaces of the connector body, cover plates being slidably secured to different surface portions of the connector body in order to selectively shield or expose the receptacles, the cover plates also having polarized apertures in order to assure proper engagement of a plug within each receptacle.

It is yet another object of the invention to provide an improved electrical connector of the extension or cube type adapted for shielding by one or more cover plates, the connector having a unitary body forming elongated slots for slidably receiving the safety cover plates and preferably being formed with a cavity extending between the contact sockets of the multiple receptacles in order to reduce the amount of material required to form the unitary connector body.

Additional objects and advantages of the invention are made apparent in the following description having reference to the accompanying drawings.

DESCRIPTION OF THE PREFERRED EMBODIMENT

As will be described in greater detail below, the present invention contemplates an extension or cube type connector as generally indicated at 10, the connector being formed with multiple receptacles such as those indicated at 12, 14 and 16 arranged with an integral or unitary connector body 18. As one basic concept of the present inventon, separate cover plates 20 and 22 are slidably secured to the connector body 18 in order to selectively shield all of the receptacles 12, 14 and 16 or to expose any number of the receptacles while continuing to shield the remaining receptacles. As another concept of the invention, multiple receptacles may be formed with polarized contact sockets as will be described in greater detail below, the cover plates 20 and 22 having polarized openings or apertures as will also be described in greater detail below in order to assure proper engagement of an electrical plug with any one of the receptacles. In accordance with the following description, the present invention contemplates the use of the features summarized above either individually or in various combinations.

Figure 7:
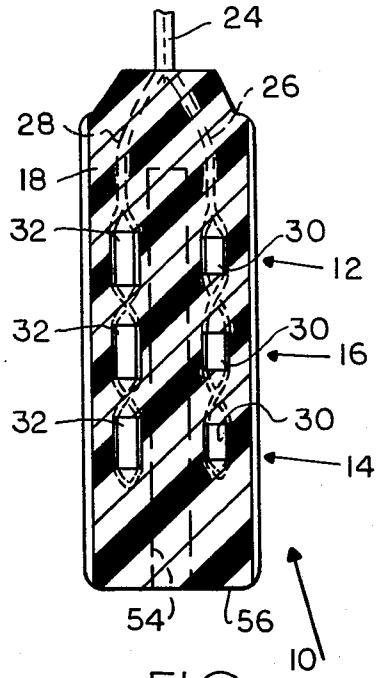
FIG. 7 is a view taken along section line VII—VII of FIG. 3.

Referring particularly to FIG. 7, the cube type connector 10 is preferably adapted for mounting or attaching at the end of an electrical cord or line 24. The electrical conductors 26 and 28 within the cord 24 are separated in the connector body 18 to form a conventional parallel circuit with opposite contacts 30 and 32 of each receptacle. Separate sockets 34 and 36 are formed by the connector body 18 in register with each of the contacts 30 and 32. In the preferred connector embodiment as best seen in FIGS. 1–3 and 7, the outer most receptacles 12 and 14 are formed with their contact sockets 34 and 36 extending toward or opening upon a common surface 38 of the connector body. The contact sockets 34 and 36 for the central receptacle 16 extend toward or open onto an opposite surface 40 of the connector body as may be best seen for example in FIGS. 3 and 5.

Referring now to FIGS. 1–4, the first cover plate 20 is arranged in parallel, slidable arrangement relative to the surface 38 in order to either expose or shield the contact sockets for the receptacles 12 and 14. Similarly, having reference to FIGS. 3–6, the second cover plate 22 is arranged in parallel slidable relation to the other surface 40 of the connector body in order to selectively expose or shield the contact sockets for the central receptacle 16.

Figure 2:
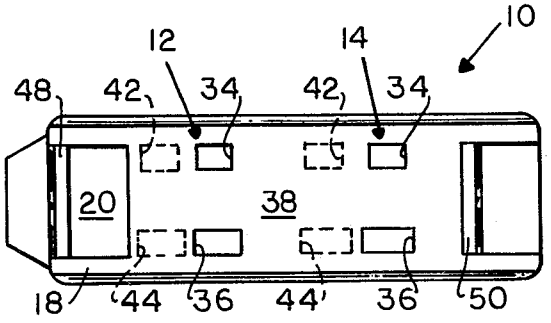
FIG. 2 is a similar view of the connector of FIG. 1 with the cover plate being in a closed position.
Figure 1:
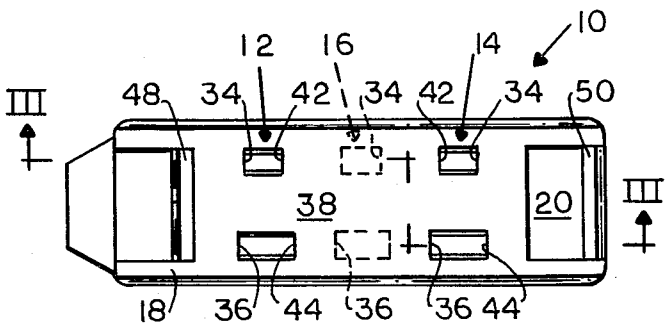
FIG. 1 is a plan view of an electrical connector constructed in accordance with the present invention and having a safety cover positioned to expose a pair of plug-in receptacles.

Preferably, the connector 10 is of a type wherein the socket contacts 30 and 32 for each of the receptacles are adapted for polarized engagement or connection with a suitable electrical plug (not otherwise shown). According to the present invention, the cover plates 20 and 22 not only permit selective shielding or exposing of the three receptacles but also serve the additional function of assuring proper polarized engagement of the plug with each of the receptacles. As may be seen in FIGS. 1–3, the cover plate 20 is formed with two pairs of polarized (or differently sized) apertures 42 and 44. The two pairs of apertures 42, 44 are formed upon the cover plate 20 so that they may be simultaneously in register with the contact sockets 34, 36 for the two receptacles 12 and 14. Thus, the single cover plate 20 may be positioned either as illustrated in FIG. 1 to simultaneously expose both receptacles 12 and 14 or it may be positioned as illustrated in FIG. 2 to simultaneously shield the contact sockets for both receptacles 12 and 14.

Figure 4:
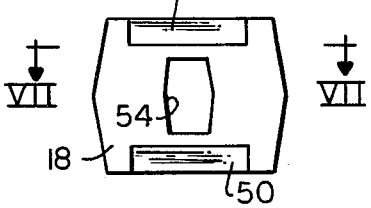
FIG. 4 is an end view of the connector of FIG. 3.
Figure 6:
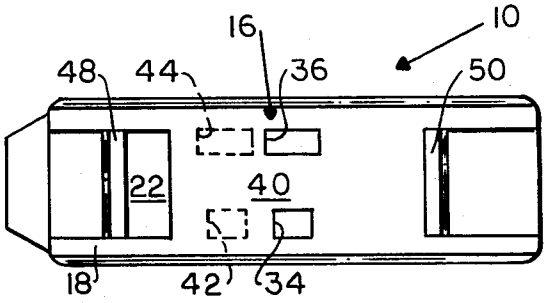
FIG. 6 is a similar view of the connector of FIG. 5 with the cover plate in a closed position.
Figure 5:
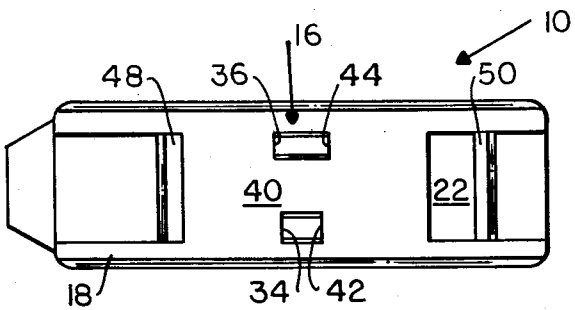
FIG. 5 is a plan view of the opposite side of the connector of FIGS. 1 and 2 with an additional cover plate being in an open position for exposing an additional plug-in receptacle.

At the same time, as may be best seen in FIGS. 3–6, the second cover plate 22 is formed with a single pair of polarized apertures 42 and 44. Thus, the second cover plate 22 may be positioned either as illustrated in FIG. 5 to expose the contact sockets of the central receptacle 16 or it may be positioned as illustrated in FIG. 6 to shield the receptacle 16.

Through the combination of the two cover plates 20 and 22, it is thus possible to simultaneously shield all three of the receptacles or else to expose any selected number of the receptacles. For example, the cover plate 20 may be left in the closed position of FIG. 2 while the second cover plate is shifted to the position of FIG. 5 in order to expose the single receptacle 16 while shielding the other two receptacles 12 and 14. Conversely, both of the cover plates 20 and 22 may be shifted to the positions of FIGS. 1 and 6 respectively in order to simultaneously expose the two receptacles 12 and 14 while shielding the third receptacle 16. Finally, it is also of course possible to then simply shift the second cover plate 22 to the position of FIG. 5 so that all three receptacles 12, 14 and 16 are exposed for use.

Figure 3:
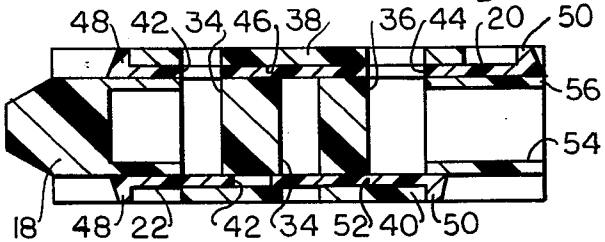
FIG. 3 is a view taken along section line III—III of FIG. 1.

Referring particularly to FIG. 3, the unitary connector body 18 is preferably formed with an elongated slot 46 arranged parallel to and just underlying the one surface 38. The first cover plate 20 is slidably arranged within the slot 46 and has end tabs or projections 48 and 50 which serve both to assure capture of the cover within the slot and to permit manipulation of the cover plate.

Similarly, the connector body 18 forms another elongated slot 52 parallel to and just underlying the other surface 40 for slidably receiving the second cover plate 22. The second cover plate 22 is also formed with tabs or projections 48 and 50 to assure its capture within the slot 52 and to permit manipulation of the second cover plate.

As may be best seen in FIGS. 3 and 4, the connector body 18 is also formed with a centrally located cavity 54 extending from the free end 56 of the connector body between the contact sockets 34 and 36 of each receptacle in order to reduce the amount of material necessary for forming the connector body 18. The connector body and the two cover plates 20 and 22 are of course formed from insulating material such as a suitable plastic.

Numerous modifications and variations are of course possible within the present invention in accordance with the preceding description. For example, it would of course be possible to form the single cover plate 20 as separate cover plates adapted to selectively expose the contact sockets 34 and 36 for the receptacles 12 and 14. However, the unitary form for the cover plate 20 is a preferable feature of the invention in order to provide only the two movable parts comprising the first and second cover plates 20 and 22 for either shielding all three receptacles 12, 14 and 16 or for exposing any given number while continuing to shield the remaining receptacles. Accordingly, the scope of the present invention is defined only by the following appended claims.

What is claimed is:

1. In an electrical connector of the extension type including a body having a pair of spaced-apart, plug-in receptacles arranged upon one surface of the connector body and a third plug-in receptacle arranged upon an opposite surface of the connector body, each receptacle including a pair of contact sockets for selectively receiving the prongs of a plug-type connector, the improvement comprising the body being of unitary construction and forming first and second elongated slots respectively underlying said one surface and said opposite surface, a first cover plate slideably arranged within said first slot, said first cover plate forming two pairs of apertures arranged for alignment with the contact sockets of the two receptacles whereby said first cover plate may be positioned to simultaneously expose or shield both receptacles, and a second cover plate slideably disposed within said second slot and forming a single pair of apertures arranged for alignment with the contact sockets of the single receptacle whereby said first and second cover plates may be slideably positioned to alternatively expose one, two or three receptacles or to simultaneously shield all three receptacles.

2. The electrical connector of claim 1 wherein said first and second slots extend longitudinally of the connector body, said first and second cover plates including projecting means to assure retention of said cover plates within said respective slots and to facilitate manipulation of said cover plates.

3. The electrical connector of claim 2 wherein the three plug-in receptacles are of polarized configuration, said first and second cover plates being formed with polarized apertures.

4. In an electrical connector of the extension type including a body having a pair of spaced-apart, plug-in receptacles arranged upon one surface of the connector body and a third plug-in receptacle arranged upon an opposite surface of the connector body, each receptacle including a pair of contact sockets for selectively receiving the prongs of a plug-type connector, the improvement comprising said body being formed from insulating material and being of unitary construction forming first and second elongated slots extending longitudinally of said connector body in underlying relation to said one surface and said opposite surface respectively, a first cover plate being slideably disposed within said first slot and forming two pairs of apertures arranged for alignment with the contact sockets of the two receptacles, said one cover plate including lateral projection means extending out of alignment with said first slot in order to assure capture of said first cover plate within said first slot and to facilitate its manipulation, a second cover plate being slideably disposed within said second slot and forming a single pair of apertures arranged for alignment with the contact sockets of the single receptacle, said second cover plate including lateral projection means extending out of alignment with said second slot to assure its capture within said second slot and to facilitate its manipulation, the combination of said first and second cover plates being slideably positionable to alternatively expose one, two or three receptacles or to simultaneously shield all three receptacles.

5. The electrical connector of claim 4 wherein said integral body further forms an elongated centrally aligned cavity extending between the contact sockets of the receptacles to reduce the mass of the connector body, the three receptacles being of a polarized configuration, said first and second cover plates including polarized apertures to assure formation of properly polarized electrical connections within said electrical connector.

6. The electrical connector of claim 4 wherein said projection means on said first and second cover plates comprise projections at opposite ends thereof.

* * * * *